US010035639B2

(12) United States Patent
Machado

(10) Patent No.: US 10,035,639 B2
(45) Date of Patent: Jul. 31, 2018

(54) TREATMENT OF MODIFIED ATMOSPHERE PACKAGING

(71) Applicant: FIRMA IP CORP., Henderson, NV (US)

(72) Inventor: Craig D Machado, Grover Beach, CA (US)

(73) Assignee: FreshTec, Inc., Carson City, NV (US)

( * ) Notice: Subject to any disclaimer, the term of this patent is extended or adjusted under 35 U.S.C. 154(b) by 0 days.

(21) Appl. No.: 15/389,261

(22) Filed: Dec. 22, 2016

(65) Prior Publication Data

US 2017/0101248 A1 Apr. 13, 2017

Related U.S. Application Data

(60) Division of application No. 13/986,851, filed on Jun. 12, 2013, now Pat. No. 9,527,648, which is a continuation of application No. 13/090,096, filed on Apr. 19, 2011, now abandoned.

(60) Provisional application No. 61/325,816, filed on Apr. 19, 2010.

(51) Int. Cl.

| | |
|---|---|
| ***B65D 81/24*** | (2006.01) |
| ***B65B 31/00*** | (2006.01) |
| ***B65D 81/28*** | (2006.01) |
| ***B65B 25/04*** | (2006.01) |

(52) U.S. Cl.

CPC ..... *B65D 81/24* (2013.01); *B65B 25/041* (2013.01); *B65B 31/00* (2013.01); *B65D 81/28* (2013.01)

(58) Field of Classification Search

CPC ..... B65D 81/24; B65D 31/00; B65D 81/28; B65B 25/041

USPC ..... 206/213, 204; 312/31.1, 31.2

See application file for complete search history.

(56) References Cited

U.S. PATENT DOCUMENTS

| | | | | | |
|---|---|---|---|---|---|
| 1,050,706 | A * | 1/1913 | Taylor | F24F 3/1411 | 123/198 R |
| 1,481,971 | A * | 1/1924 | Whiting | A24F 25/02 | 206/204 |
| 1,601,625 | A * | 9/1926 | Hruby | B65D 81/266 | 116/DIG. 22 |
| 2,508,775 | A * | 5/1950 | Schaumann | C22B 34/1231 | 203/32 |
| 3,918,578 | A * | 11/1975 | Cullen | B65D 51/30 | 206/204 |
| 4,256,770 | A * | 3/1981 | Rainey | A23B 7/148 | 206/204 |
| 5,716,432 | A * | 2/1998 | Perrine | B01D 53/0431 | 206/204 |
| 5,813,564 | A * | 9/1998 | Luo | B65D 51/30 | 206/204 |
| 5,934,773 | A * | 8/1999 | Ferrell | A24F 25/02 | 206/204 |

(Continued)

*Primary Examiner* — Chun Cheung

(74) *Attorney, Agent, or Firm* — Jonathan A. Kidney; CKR Law LLP

(57) ABSTRACT

The invention relates to a device for preserving, sanitizing, ripening, and preventing or suppressing the growth of microbials within a package used for the transport and storage of various items, such as fresh fruits, vegetables, and other perishables and parcels. The device includes an enclosed container and at least one sack operably disposed adjacent the container, wherein the sack encloses an agent and the agent releases gases in the container upon the presence of humidity within the container.

14 Claims, 7 Drawing Sheets

(56) References Cited

U.S. PATENT DOCUMENTS

| | | | | |
|---|---|---|---|---|
| 7,591,369 | B2 * | 9/2009 | Lin | A63B 47/00 206/204 |
| 2014/0209488 | A1 * | 7/2014 | Dai | B65D 81/268 206/204 |

* cited by examiner

TREATMENT OF MODIFIED ATMOSPHERE PACKAGING

RELATED APPLICATIONS

This divisional application claims the benefit and priority of application Ser. No. 13/986,851 filed Jun. 12, 2012, soon-to-be granted as U.S. Pat. No. 9,527,648, which is a continuation of application Ser. No. 13/090,096 filed on Apr. 19, 2011, which claims the benefit of Application No. 61/325,816, filed Apr. 19, 2010, which are incorporated herein in their entireties.

BACKGROUND OF THE INVENTION

1. Field of Invention

The present invention relates generally to the preservation, sanitization, fumigation and ripening of food and floral products sand other items, such as mail, that are subject to various exposures and environments and potentially hazardous conditions while being stored, treated, shipped and distributed.

2. Description of Related Art

Consumers desire the freshest fruits, vegetables, meats, seafood and floral products to be available for purchase and expect them to be available year round. Food and floral growers, packers, processors and distributors have tried to satisfy this desire by shipping fruits, vegetables, meats, seafood and floral products from around the world. However, all fruits, vegetables, meats, seafood and floral products require time for logistics and distribution and require considerable time when being shipped across countries, continents and oceans and a combination thereof; for example, products shipped from the America to Europe can require more than 28 days to reach a final destination, end user or consumer. This travel time uses up valuable shelf life for the items being transported, such as but not limited to, fruits, vegetables, meats, seafood and floral products. To assure and maintain the integrity, grade, quality and sellability, most fruit and vegetable growers, packers and distributors must harvest these products immature or prior to be being fully ripe, to allow for the time requirements for shipping and logistics. Or, they must transport these items using a faster and more costly means.

The delay of aging or senescence, the natural form of deterioration, of fresh fruits, vegetables and floral products is the main goal in the preservation of these fresh fruits, vegetables and floral products, as senescence accounts for the majority of post-harvest losses. Senescence is endogenously controlled and is the stage when extensive catabolic reactions occur, resulting in dissolution of plant membranes. It is marked by chlorophyll loss, decreases in RNA and protein content, and tissue softening. Plants, for example, senesce to re-route materials into seeds representing the next generation; it is therefore a pre-destined apoptosis process that can only be delayed, not completely inhibited. The aging of fresh fruit and produce is increased with an increase in respiration. The rate of respiration of a fruit, vegetable or floral is inversely proportional to the shelf life of the product. A higher rate of respiration decreases the shelf life. A byproduct in the respiration of fresh fruits, vegetables and floral is an increase in ethylene production, a process referred to as climacteric. It is therefore reasonable to assume that maintaining and reducing ethylene perception and production may effectively delay senescence.

In an attempt to provide fruits, vegetables and floral products with the longest shelf life, growers have resorted to harvesting their fruits, vegetables and floral long before ripening. Early stage harvesting of fruits and vegetables, at low stages of maturity, prevents the development of natural sugars, nutrients and textures. Conventional devices, such as refrigeration and Modified Atmosphere Packaging (MAP), have been made to extend the shelf life of fruits, vegetables, floral and other perishable products. Examples of such conventional device related to Modified Atmosphere Packaging (MAP) are disclosed in U.S. Pat. Nos. 6,880,748 and 7,597,240, both of which are incorporated herein by reference in their respective entireties. The aim of conventional MAP devices is the extension of product shelf life, since fruits and vegetables are still alive and respiring when harvested and packed. Other factors, such as wounding, also affect the post-harvest shelf life extension of fresh fruits, vegetables and floral products and the success of modified atmosphere packaging.

Wounding of fresh fruit and produce also increases the respiration, thus decreasing the life span. Respiration can be measured by the oxygen uptake or by production of carbon dioxide ($CO_2$). Respiration also produces heat and water vapor, both of which can reduce the shelf life of fresh produce and fruits. Since an aim of conventional MAP packaging systems is to increase the life span of fresh fruits, vegetables and floral, it is therefore an aim to reduce the respiration of the same, which can be achieved by decreasing the levels of oxygen ($O_2$) within the MAP container. However, low $O_2$ levels, one to two percent by volume, create ideal conditions for pathogens (or germs), such as *clostidium botulinum*. The increase of heat, production of water and low $O_2$ are problems often found with conventional MAP devices.

As mentioned above, ethylene, a plant hormone, plays a large role in shelf life of fresh fruits and produce and causes a marked increase in respiration rates and enhances ripening and senescence. In some commodities, accelerated aging and the initiation of ripening can occur following exposure to ethylene concentrations as low as 0.1 ml/l. As senescence begins, spoilage due to indigenous bacteria can be augmented. Ethylene is also a byproduct of the aerobic combustion of hydrocarbons, and it is therefore important during the handling of produce to maintain low levels of environmental ethylene, which are often increased by forklifts and other machinery. Different biological structures of assorted produce varieties contribute to the product's sensitivity response to ethylene, as well as the response to $O_2$ and $CO_2$. Furthermore, different stages of maturity, cultivar and post-harvest storage conditions also influence sensitivity to ethylene. Conventional packaging and some MAP systems fail to include control measures to minimize production of ethylene following harvest. The present invention includes such measures as storage in a modified atmosphere at optimal and or reduced temperatures (below traditional recommended injury threshold) and oxidizing the ethylene by various chemical and physical means. Ethylene Absorbing Packets (EAP) may be employed to extend the shelf life of fruits, vegetables and flowers in a packaged or bulk environment. Ethylene absorbing packets are constructed with natural occurring zeolites. EAPs remove unwanted ethylene gas through the oxidation process, thereby ensuring the quality of freshness of the product, while in transit or in storage.

While conventional MAP devices do provide some means to control the atmosphere of packaging, conventional MAP devices fail to control the suppression or release of gases known to enhance or suppress the ripening of fresh fruits and produce, such as $CO_2$, $O_2$ Ethylene and Nitrogen.

Further, conventional MAP devices fail to provide a delivery system to regulate or activate ingredients in order to reduce oxygen levels. Oxygen supports the growth of micro-organisms, causes product color changes, and causes rancid odors in packaged foods.

The conventional MAP packaging systems also fail to provide for the sanitization of the products during shipping and ripening of the products. Another hazard in the shipment of fresh fruits and produce is the control of micro-organisms and the presence of live insects. Conventional MAP devices fail to provide a method to enable an insecticide to be dispensed within the MAP to control micro-organisms and insects. Such a failure limits the shipment of some fresh fruits and vegetables to many countries.

SUMMARY OF THE INVENTION

It is an object of the present invention to overcome the drawbacks and shortcomings of conventional Modified Atmosphere Packaging (MAP) devices in the distribution of perishable fresh food products. This present invention provides a device and method to extend the shelf life and life span of perishable fresh food and floral products.

The present invention additionally provides the capability to delay the ripening of perishable fresh food products.

Further, the present invention provides for the sanitization of perishable fresh food products within a modified atmosphere Still further, the present invention, provides at a selected opportunity, for the ripening of perishable fresh food products.

Additionally, the present invention controls the addition and the reduction of gases required for the preservation of perishable fresh food products, such as, but not limited to $CO_2$, $O_2$ Ethylene and Nitrogen.

This invention overcomes the drawbacks and shortcomings of the prior art conventional devices and systems.

The present invention provides a packaging system that comprises an enclosed container; and at least one agent releasable sack operably configured to release an agent within the container.

Further, the present invention is a food packaging device, which comprises a modified atmosphere package, having a lid with a recess; and, at least one agent releasable sack disposed within the recess and operably configured to release an agent within the modified atmosphere package.

Additionally, in another exemplary embodiment, the present invention provides a container that is operably configured to contain at least one of fresh fruits and produce, and comprises at least one agent releasable sack operably configured to release an agent within the container; and, a valve operably configured to release a gas from within the container.

Still further, in an alternative embodiment of the present invention a releasing device for releasing an agent within a container is disclosed. This embodiment comprises a first chamber having a plurality of orifices, wherein the agent is disposed within the first chamber; a second chamber having a plurality of orifices, wherein the first chamber is disposed within the second chamber; and, wherein the second chamber is disposed within the container.

The present invention further includes a method of packaging comprising the steps of: obtaining a container operably configured to enclosably hold products; placing the products within the container; obtaining at least one agent releasable sachet operably configured to release an agent within the container; and attaching the at least one agent releasable sachet so that the agent is release into the container.

These and other features and advantages of this invention are described in, or are apparent from, the following detailed description of various exemplary embodiments of the devices and methods according to this invention.

BRIEF DESCRIPTION OF THE DRAWINGS

Various exemplary embodiments of this invention will be described in detail, with reference to the following figures, wherein.

DETAILED DESCRIPTION

It will be readily appreciated that the many embodiments of the present invention can be utilized in a wide variety of applications and industries. The present invention can be utilized with the transportation, treatment, and storage of a plethora of items. Items such as but not limited to produce, cheeses, flowers, poultry and other meats and seafoods, nuts, dehydrated foods, mail, parcels, medical tools and equipment, etc. The items can be treated while being transported and or stored. Such treatments are carried out through the use of the various treatment sacks or sachets of the present invention as described below. The sacks, depending upon the application may be utilized to sanitize, eliminate and/or inhibit molds and/or pathogens, delay ripening and aging or senesce, and the like.

Conventional Modified Atmosphere Packaging (MAP) devices modify the atmosphere of fresh fruits and products by controlling the amount of carbon dioxide ($CO_2$) within the packaging by the use of a permeable membrane. One such device is a rigid container as described in U.S. Pat. Nos. 6,880,748 and 7,597,240. Other designs of MAPs include non-rigid or soft containers, such as bags. The present invention expands on the MAP devices by including at least one agent releasable device. The at least one agent releasable device or agent releasable sack, which at the choice of a user, has the capability to release at least one agent into the MAP and thus further modify the atmosphere of the MAP to gain the desired effect of the user. Examples of some agents available for release into the MAP are, but are not limited to, an insecticide, anti-microbial agent, ethylene gas, nitrogen gas or a combination. Additionally, the releasing device may also be configured to control a release of chlorine dioxide ($ClO_2$) for sanitation of the contents of packaging. Additionally, the present invention provides a method for releasing agents into a modified atmospheric package.

Figure 1:
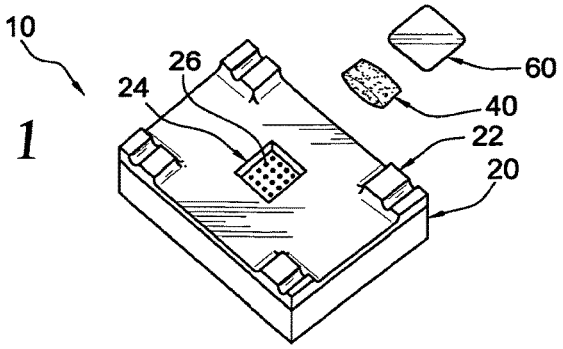
FIG. 1 is an exploded perspective view of a packaging system made in accordance with this invention.

FIG. 1 is an exploded perspective view of an exemplary embodiment for the packaging system 10, made in accordance with the present invention. The packaging system 10 includes a container 20, and at least one agent releasable sack 40.

The device 10, as shown in FIG. 1, is shown using a container 20 which is an example of a modified atmosphere package such as the containers described in U.S. Pat. No. 6,880,748, which includes a lid 22 for the container 20. It should be appreciated that in other various exemplary embodiments, other rigid type modified atmosphere packaging and non-modified atmosphere packing may be used. The present invention includes the lid 22, with a recessed area 24. The recessed area 24 includes a plurality of orifices 26. In this exemplary embodiment, as shown in FIG. 1, the at least one agent releasable sack 40 is disposed within the recessed area 24.

Figure 2:
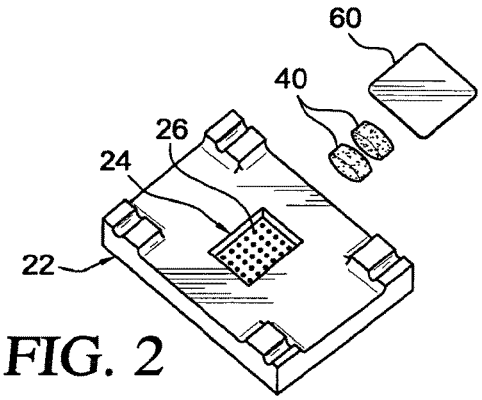
FIG. 2 is an exploded perspective view of an alternative embodiment of a lid shown in the packaging system of FIG. 1.
Figure 3:
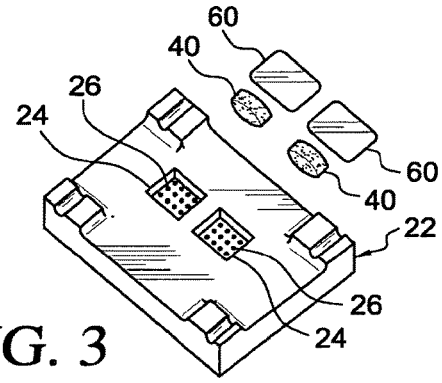
FIG. 3 is an exploded perspective view of another alternative embodiment of a lid shown in the packaging system of FIG. 1.

While the present embodiment depicts one recessed area 24 and at least one agent releasable sack 40, it should be appreciated that in other various exemplary-embodiments, two or more recessed areas may be included, wherein each recessed area contains at least one agent releasable sack, as shown in FIG. 2. Further, it should be appreciated that in other various exemplary embodiments, the recessed area may be of sufficient size to contain a second agent releasable sack, as shown in FIG. 3. The sacks 40 in this exemplary embodiment include different agents from each other and in other various exemplary embodiments the sacks include the same agents.

The device 10, as shown in FIG. 1, further includes a patch 60. The patch 60 in the present embodiment is an adhesive patch operably configured to cover the recessed area 24 and retain the at least one agent releasable sack 40 in the recessed area 24. The patch 60 is operably configured to hold the sack 40 in place adjacent to the container 20. The patch 60 may also include a label (not shown) to indicate what type of agent is in the at least one agent releasable sack 40. Additionally, it should be considered that in other various exemplary embodiments, the patch may include a selectable porosity, permeability and or be temperature activated to selectively control gas exchanges, as is common in the art, as will be discussed below. The sacks or sachets of the present invention are preferably moisture activated. Particularly the sachets or sacks of the present invention will utilize humidity within the container to trigger the reaction of the agent or treatment in the sack. The humidity in the container will be made present from the storage of items in the container, such as produce and the like.

The at least one agent releasable sack or sachet 40 in the present embodiment his a dry chemical sachet, commonly known in the art of dry chemical sachets. One example of a dry chemical sachet that may be employed in the present embodiment is a Food and Drug Administration (FDA) Generally Recognized As Safe (GRAS) or foreign lands approved insecticide such as, but not limited to, sulfur dioxide. However, it should be appreciated that in other various exemplary embodiments, the sachet 40 may contain an anti-microbial such as but not limited to chlorine dioxide. Still further, the sachet 40 may contain releasable gases such as but not limited to ethylene, carbon dioxide or nitrogen.

An example of the at least one agent releasable sack 40 is described in a report tilted EFFICACY OF CHLORINE DIOXIDE GAS SACHETS FOR ENHANCING THE MIRCROBIOLOGICAL QUALITY AND SAFETY OF BLUEBERRIES by Popa, I; Hanson, E J; Todd, E C; Schilder, A C; and Ryser, E T of the Department of Food Science and Human Nutrition, Michigan State University, East Lansing, Mich. 48824, Sep. 7, 2009. "In response to increasingly stringent microbial specifications being imposed by purchasers of frozen blueberries, chlorine dioxide (ClO2) gas generated by a dry chemical sachet was assessed for inactivation of *Listeria monocytogenes, Salmonella* spp., and *Escherichia coli* O157:H7 as well as five yeasts and molds known for blueberry spoilage. Fresh blueberry samples (100 g) were separately inoculated with cocktails of *L. monocytogenes, Salmonella, E. coli* O157:H7 (three strains each), or yeasts and molds (five strains each) to contain approximately 10(6) CFU/g and exposed to ClO2 (4 mg/liter, 0.16 mg/g) for 12 h a sealed 20-liter container (99.9% relative humidity) at approximately 22 degrees C. After gassing, 25 g of blueberries was added to 225 ml of neutralizing buffer, pulsified for 1 min, and plated using standard procedures to quantify survivors. This treatment yielded reductions of 3.94, 3.62, 4.25, 3.10, and 3.17 log CFU/g for *L. monocytogenes, Salmonella, E. coli* O157:H7, yeasts, and molds, respectively. Thereafter, 30 lugs of uninoculated blueberries (approximately 9.1 kg per lug) were stacked on 1.2 by 1.2-m pallets (5 lugs per level×six levels), tarped, and exposed to ClO2 (18 mg/liter, 0.13 mg/g) for 12 h. After gassing, significant ($P<0.05$) reductions of 2.33, 1.47, 0:52, 1.63, and 0.48 log CFU/g were seen for mesophilic aerobic bacteria, coliforms, *E. coli*, yeasts, and molds, respectively, compared with non-gassed controls. No significant differences ($P>0.05$) in microbial inactivation were seen between lug levels and, with one exception (mesophilic aerobic bacteria), between the bottom and top surface of individual lugs. Based on these findings, ClO2 sachets may provide a simple, economical, and effective means of enhancing the microbial shelf life and safety of blueberries:"

Similarly, in an article by S. Y. Lee, M. Costello and D. H. Kang of the Department of Food Science and Human Nutrition, Washington State University, Pullman, Wash., 99164 dated September 2007 states the following: "Aqueous solutions of sodium hypochlorite or hypochlorous acid are typically used to sanitize fresh fruits and vegetables. However, pathogenic organisms occasionally survive aqueous sanitization in sufficient numbers to cause disease outbreaks. Chlorine dioxide ($ClO_2$) gas generated by a dry chemical sachet was tested against foodborne pathogens on lettuce leaves. Lettuce leaves were inoculated with cocktail of three strains each of *Escherichia coli* O157:H7, *Listeria monocytogenes*, and *Salmonella* Typhimurium and treated with $ClO_2$ gas for 30 min, 1 h, and 3 h in a model gas cabinet at room temperature (22±2° C.). After treatment, surviving cells, including injured cells, were enumerated on appropriate selective agar or using the overlay agar method, respectively. Total $ClO_2$-generated by the gas packs was 4.3, 6.7, and 8.7 mg after 30 min, 1 h, and 3 h of treatment, respectively. Inoculated lettuce leaves exposed to $ClO_2$ gas for 30 min experienced a 3.4-log reduction in *E. coli*, a 4.3-log reduction in *Salmonella* Typhimurium, and a 5.0-log reduction in *L. monocytogenes* when compared with the control. After 1 hour, the three pathogens were reduced in number of CFU by 4.4, 5:3, and 5.2 log, respectively. After 3 h, the reductions were 6.9, 5.4, and 5.4 log, respectively. A similar pattern emerged when injured cells were enumerated. The $ClO_2$ gas sachet was effective at killing pathogens on lettuce without deteriorating visual quality. Therefore, this product can be used during storage and transport of lettuce to improve its microbial safety." This type of agent is utilized in the sack in another exemplary embodiment made in accordance with the present invention.

Another example of a dry chemical sachet that may be employed in the at least one agent releasable sack or sachet is an oxygen absorber type packet. An oxygen absorber packet can be used to prolong the shelf life of food and retard the growth of oxygen using aerobic micro-organisms such as fungi. The presence of oxygen in the packaging of fresh fruits and produce supports the growth of micro-organisms and cause changes in color of the product. The presence of oxygen in the packaging also can cause rancid odors. Oxygen absorbers absorb oxygen and effectively reduce the aerobic environment and can be used to achieve a 0% oxygen level within the packaging. Therefore, aerobic bacteria and fungi are less likely to grow in an oxygen depleted environment. An advantage of oxygen sachets versus vacuum packaging is that the food products are not crushed or squeezed, as some products are of high value or can be damage easily from the packaging. Another advantage is simplicity of use. Oxygen-absorbers are made in different formulations to match the water activity of different foods. Oxygen absorbers can be activated by the presence of humidity. An example of an oxygen absorber common in the art is a sachet of iron carbonate.

Still another example of a dry chemical sachet that may be employed in the at least one agent releasable sack or sachet is a carbon dioxide generating type packet. One type of carbon dioxide generating sachet can be found in U.S. Pat. No. 6,797,235, by Boldt.

Further, it is anticipated by the present invention that products other than fresh fruits and vegetables will benefit from this invention. For instance, certain flowers or meat products that do not require a modified atmosphere package may be banned from being shipped into certain countries because of micro-organisms that may infest the flowers. The packaging system 10 of the present invention may be use to disperse an insecticide on such products, even though a MAP is not required, thus allowing a supplier access to more locations for his products.

In the present embodiment, the at least one agent releasable sack 40 is constructed using various paper and polymer combinations, which are filled with microspheres embedded with chemicals, anti-oxidants, herbs, spices and plant based materials. An example of an at least one agent releasable sack 40 can be found in U.S. Patent Application number 2008/0131395, which is incorporated herein by reference in its entirety.

The at least one agent releasable sack 40, in various other exemplary embodiments includes a temperature controlled release valve. Particularly, one exemplary embodiment would include that sack lining being comprised of a material that acts as a valve at particular temperatures. As fresh fruits and produce are shipped, they are also refrigerated. As the produce nears the intended destination, the temperature of the environment of the device 10 may be warmed. At a preset temperature, the temperature release valve opens and a gas chosen by the user is released into the package 20. For example, an erogenous ethylene gas may be introduced through the release valve into the MAP environment. The introduction of ethylene gas will wake up the product and accelerate the ripening process. The ripening process of fresh fruits, bananas, avocados, kiwi, peppers, melons, pears, stone fruits, tomatoes, etc, which are stored or contained in MAP environments, is generally suppressed by the presence of $CO_2$, which further inhibits ripening. In order to ripen, $CO_2$ must be exhaled from the package 20 and oxygen allowed to enter the MAP environment. The release of $CO_2$ and the ingestion of oxygen allows ethylene gas generated by the fruits or ethylene gas introduced to reach a proper level and become effective in ripening the fruits. An example of a $CO_2$ releasing sack can be found in U.S. Pat. No. 7,189,666, Finnegan, et al., which is incorporated herein by reference in its entirety.

Further, a hormone can be released from the sachet to assist with delaying ripening and senesce. An example of one such hormone is SmarFresh marketed by AgroFresh Inc. This hormone is a synthetic produce quality enhancer based on 1-methylcyclopropene (1-MCP). The 1-MCP's mode of action is via a preferential attachment to the ethylene receptor, thereby blocking the effects of both endogenous and exogenous ethylene. Another example is the use of a combination of 5-10% $O_2$ and 0-5% CO2 gas released by the sachets can be useful for delaying senescence and for firmness retention in produce, such as oranges. U.S. Pat. No. 6,017,849 and EP1237411 disclose incorporation of these gaseous cyclopropenes into a molecular encapsulation agent complex in order to stabilize their reactivity and thereby provide a convenient and safe means of storing, transporting, and applying or delivering the active compounds to plants, avoiding the problems presented by the unstable gases. For the most effective cyclopropene derivative disclosed in U.S. Pat. No. 5,518,988, 1-methylcyclopropene ("1-MCP"), the preferred molecular encapsulation agent is a cyclodextrin, with alpha-cyclodextrin being the most preferred. The encapsulation of 1-MCP improves the stability of the product during transportation and storage by allowing the 1-MCP to be delivered in a powdered form and later activated by contacting the complex with gaseous or liquid water to release the 1-MCP gas. Thus, the application or delivery of these active compounds to plants is accomplished by simply adding water or humidity from within the container to the molecular encapsulation agent complex that is disposed within the sack or sachet of the present invention. All of the above patents referenced in this paragraph are incorporated herein in their entireties by reference.

As mentioned above, the patch 60 is an adhesive patch operably configured to hold the sack 40 in place to the container 20. The patch 60 is also preferably configured to cover the recessed area 24. Additionally, in other exemplary embodiments, the patch 60 includes a selectable porosity, permeability and or be temperature activated to selectively control gas exchanges, as is common in the art. The patch 60 is a patch that contains thermally responsive polymers. The thermally responsive polymers are intelligent in that the polymers have permeabilities that reversibly change with small incremental changes in temperature. An example of such a patch may be found in U.S. Pat. No. 5,254,354 by Ray F. Stewart, which is incorporated herein by reference in its entirety.

Figure 4:
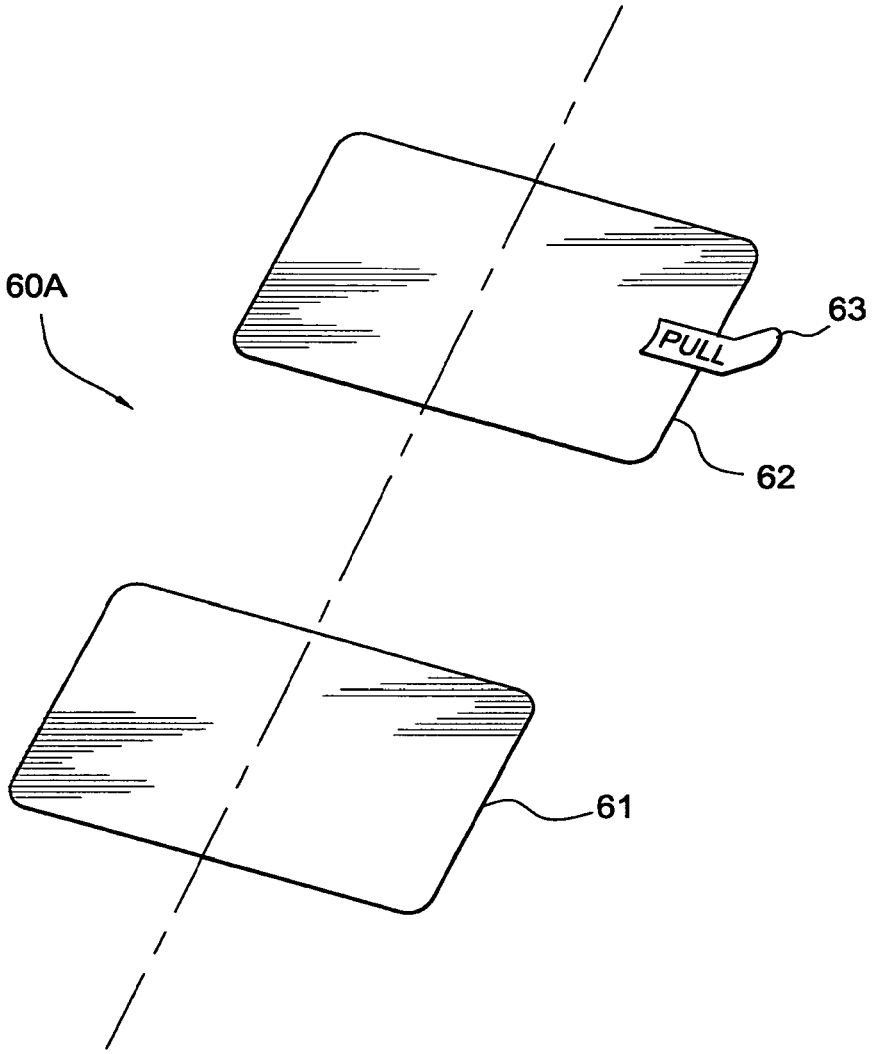
FIG. 4 is an exploded detailed view of a patch of FIG. 1.

Another embodiment of the patch 60 may be seen in FIG. 4. In FIG. 4, patch 60A is shown have a first layer 61, a second layer 62 and a tab 63. The first layer is a permeable membrane of selective permeablility, wherein the passage or escape of gases are allowed to exit the container 20. For example the first layer 61 would allow the passage of $CO_2$ but prevent the escape of chlorine dioxide ($CLO_2$).

The second layer 62 is a non-permeable material. The second layer 62 includes an adhesive common in the art to allow the second layer to be attached to the first layer 61, but easily remove by the use of the tab 63 by the user.

It should be appreciated that the various embodiments of the patch 60 may be used on any of the embodiments of the present invention described herein.

Figure 5:
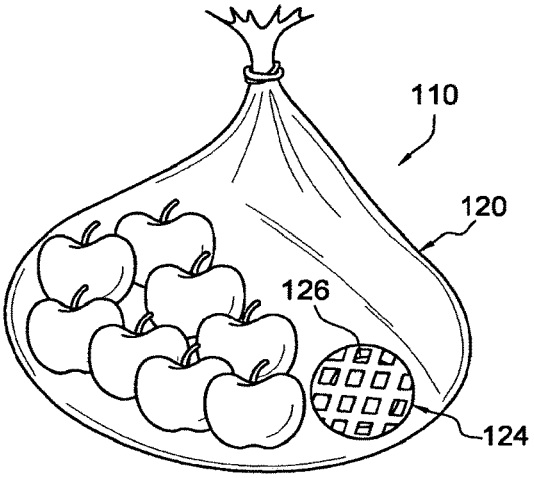
FIG. 5 is a transparent view of an alternative embodiment of the packing system of FIG. 1.

The primary exemplary embodiment of the present invention is the rigid container shown in the Machado '748 patent. However, alternative embodiments of modified atmosphere packaging are also employed in the present invention. FIG. 5 is an example of one such embodiment, showing device 110. In FIG. 5, a non-rigid or bag type MAP 120 is used. In this embodiment the bag 120 includes a first chamber 126 disposed within a second chamber 124 and an at least one agent releasable sachet 140.

Figure 6:
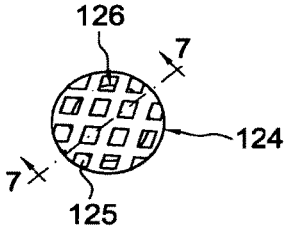
FIG. 6 is a detailed view of a chamber with a chamber as shown in FIG. 5.
Figure 7:
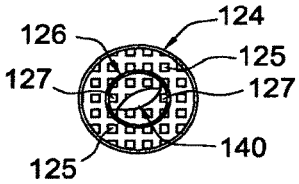
FIG. 7 is a cross-section view of the chamber with a chamber shown in FIG. 6, taken along line 7-7.

The second chamber 124 includes a plurality of orifices 125, as shown in FIGS. 6 and 7. The first chamber 126 also includes a plurality of orifices 127, as shown in FIG. 7. The at least one agent releasable sachet 140 is disposed within the first chamber 126. The second chamber 124 keeps the at least one agent releasable sachet 140 from coming in direct contact with the perishable items within the modified atmosphere packaging bag 120. While the embodiment of FIG. 5 is a non-rigid container 120, it should be appreciated that in other various exemplary embodiments, the chamber within a chamber may be inserted into rigid containers, such as, but not limited to, sealed and non-sealed recyclable plastic containers, corrugated cartons and the like.

As with the device shown in FIG. 1, the at least one agent releasable sachet 140 of the device 110, is a dry chemical sachet, commonly known in the art of dry chemical sachets. The sachet 140 may contain a FDA GRAS or foreign lands approved insecticide such as, but not limited to, sulfur dioxide. However, it should be appreciated that in other various exemplary embodiments, the sachet 140 may contain an anti-microbial such as but not limited to chlorine dioxide. Still further, the sachet 140 may contain releasable gases such as but not limited to ethylene or nitrogen.

Further, FIGS. 5 through 7 show a single at least one agent releasable sachet 140 within the non-rigid bag 120. It should be appreciated that in other various exemplary embodiments, multiple chambers within a chamber may be disposed within the non-rigid bag.

It should be further appreciated that the non-rigid container or bag could in some embodiments be inserted into other containers, such as corrugate plastic or cardboard containers or even recyclable plastic containers, even with other non-rigid bags. Still further it should be appreciated that the non-rigid container or bag, may be permeable or even nonpermeable. If the bag is non-permeable, it would be preferred to incorporate a breathable membrane patch.

Figure 8:
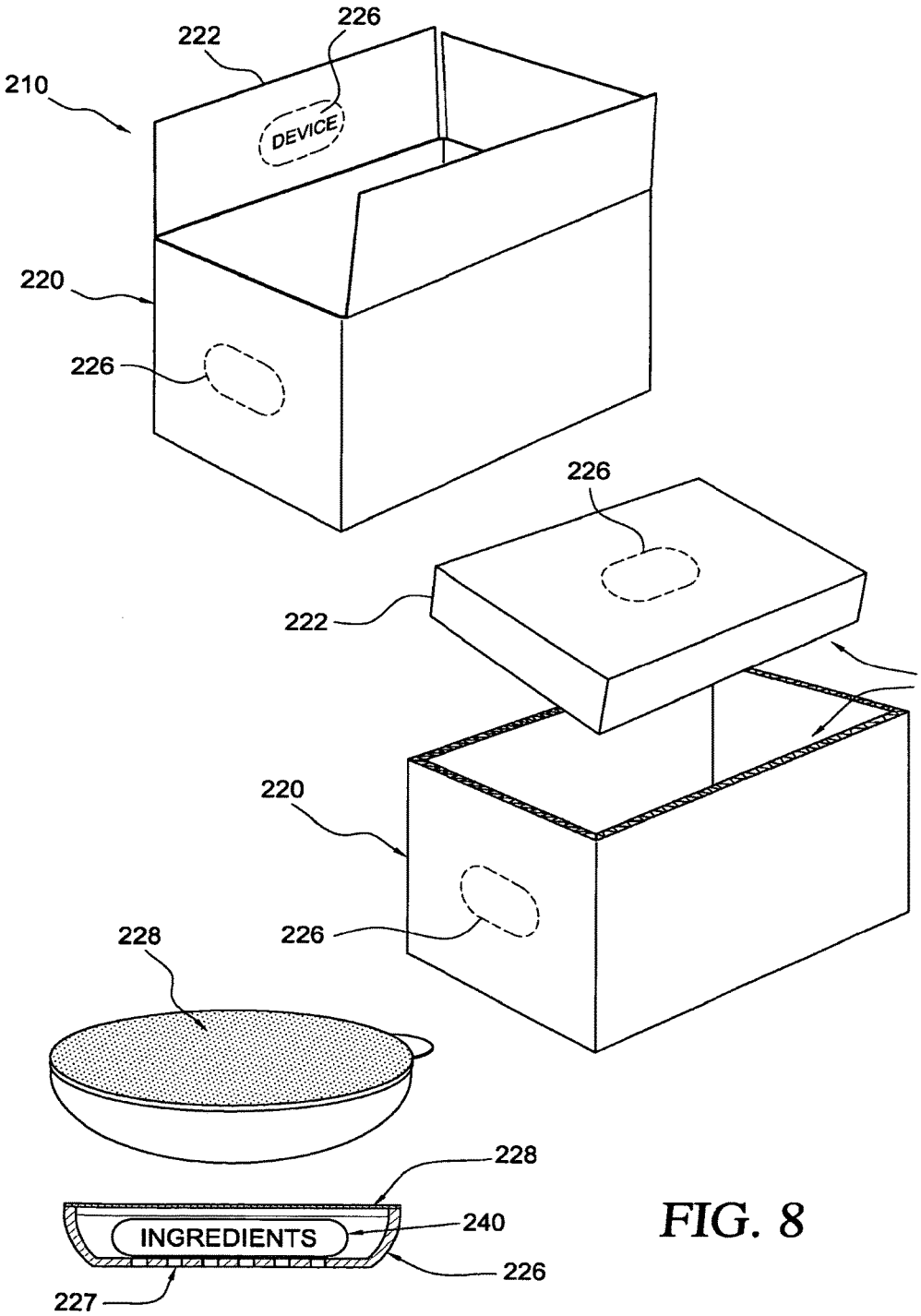
FIG. 8 is a perspective view of yet another alternative embodiment of the packing system shown in FIG. 1.

Now referring to FIG. 8, a device 210, is another exemplary embodiment of the present invention. Device 210 includes a container 220 having a lid 222 and at least one agent releasable sachet 240.

The container 220 in FIG. 8 is a standard corrugated carton. The lid 222 is additionally a standard corrugated carton lid, which may be a separable lid or an integral lid.

The at least one agent releasable sachet 240 includes the features of the at least one agent releasable sack 40 described above for device 10. The device 210 includes a vessel 226. The at least one agent releasable sack 240 is disposed within the vessel 226. The vessel 226 includes a porous portion 227 and an adhesive portion 228. The vessel 226 may be attached to the container 220 on the inside or on a portion of the lid 222 such that the at least one releasable sack 240 is exposed to the inside of the container 220.

Figure 9:
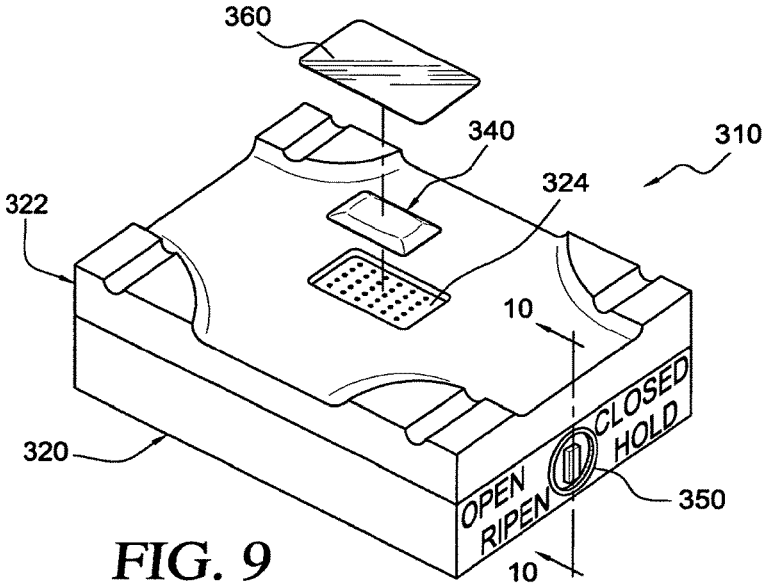
FIG. 9 is a perspective view of still another alternative embodiment of the packaging system shown in FIG. 1.

FIG. 9 is a perspective view of an exemplary embodiment for the packaging system 310, made in accordance with the present invention. The device 310 is similar to the device 10 and includes the features of device 10. The packaging system 310 includes a container 320 and at least one agent releasable sack 340.

The container 320 shown is an example of a modified atmosphere package such as those described in U.S. Pat. No. 6,880,748, which includes a lid 322 for the contain 320. It should be appreciated that in other various exemplary embodiments, other rigid type MAP devices may be used. The present embodiment includes a recessed area 324, disposed on the lid 322. The recessed area 324 includes a plurality of orifices. In this exemplary embodiment, as shown in FIG. 7, the at least one agent releasable sack 340 is disposed within the recessed area 324.

While the present embodiment depicts one recessed area 324 and one at least one agent releasable sack 340, it should be appreciated that in other various exemplary embodiments, two recessed areas may be included, wherein each recessed area contains an at least one agent releasable sack. Further, it should be appreciated that in other various exemplary embodiments, the recessed area may be of sufficient size to contain a second agent releasable sack.

The device 310, as shown in FIG. 9, further includes a patch 360. The patch 360 in the present embodiment is an adhesive patch operably configured to cover the recessed area 324 and retain the at least one agent releasable sack 340 in the recessed area 324. The patch 360 may also include a label (not shown) to indicate what type of agent is in the at least one agent releasable sack 340.

The at least one agent releasable sack or sachet 340 in the present embodiment is a dry chemical sachet, commonly known in the art of dry chemical sachets. In the present embodiment, the sachet 340 contains a FDA GRAS or foreign lands approved insecticide such as, but not limited to, sulfur dioxide. However, it should be appreciated that in other various exemplary embodiments, the sachet 340 may contain other agents such as an anti-microbial such as but not limited to chlorine dioxide. Still further, the sachet 340 may contain releasable gases such as but not limited to ethylene or nitrogen.

The device 310 further includes a valve 350. The valve 350 in the present embodiment is disposed on a side of the container 320. It should be appreciated that in other various exemplary embodiments, the valve could be disposed in other locations, such as, but not limited to, the lid.

The valve 350 is a mechanical valve, common in the art, operably configured to release gases trapped within the container 320 and allow production of naturally produced gases or gases introduced from storage in a gas ripening room.

Figure 10:
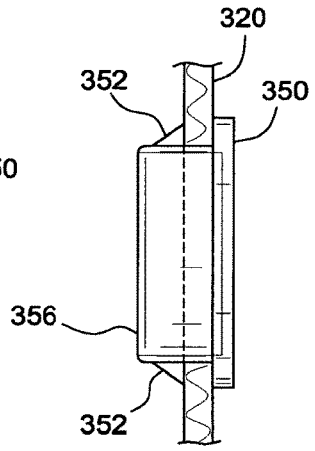
FIG. 10 is a cross-section view of a valve on FIG. 9 taken along line 10-10.
Figure 11:
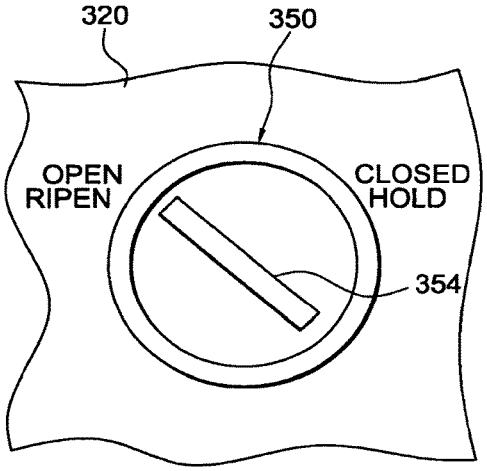
FIG. 11 is a close-up detailed view of the valve on FIG. 9.

The valve 350 as shown in FIGS. 10 and 11 includes clips 352, a rotatable knob 354 and a permeable membrane 356. The clips 352 retain the valve 350 on the container 320. The rotatable knob 354 is manually actuated to one of two positions, a first position and a second position. In the present embodiment, the first position is labeled OPEN or RIPEN and the second position is labeled CLOSED or HOLD. In the first position the valve 350 permits gases from within the container to be exited out of the container 320 through the permeable membrane 356. In the second position gases are prevented from leaving the container 320.

Figure 12A:
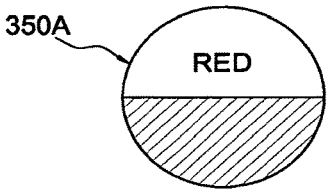
FIG. 12A is a close-up detailed view of an alternative valve of the valve on FIG. 9.
Figure 12B:
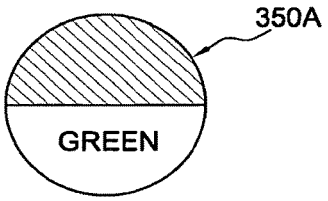
FIG. 12B is a second close-up detailed view of the alternative valve of FIG. 12A.

It should be appreciated that in various exemplary embodiments, the valve could be a temperature sensitive valve, as the temperature rises, the valve opens. FIGS. 12A and 12B show the employment of a temperature sensitive valve 350A. For example, avocados are normally stored at 41 to 44.5 degrees Fahrenheit. To awaken the fruit and enhance the ripening process of avocados, the temperature is raised to 62:5 to 68 degrees Fahrenheit and ethylene is introduced into the container 320.

The device 310 is operably configured to release carbon dioxide gas from within the container 320 to initiate the ripening of the fresh fruit or produce within the container 320. The environment outside the container 320 is warmed by the user and the user would move the valve 350 to the first or OPEN position. As the temperature warms, the sachet 340 continues to release an anti-microbial to prohibit the growth of micro-organisms within the container 320.

Further, if the environment outside the container 320 is cooled, the user would move the valve 350 to the second or CLOSED position, trapping carbon dioxide gas and slowing the ripening process.

It is anticipated in this invention that in the case of a temperature sensitive valve, the status of the valve 350A would be indicated by a first color or a second color, as indicated in FIGS. 12A and 12B. The first color in the present embodiment is RED. The first color RED is the same as the first position in FIG. 11 and indicates a ripening condition. The second color in the present embodiment is GREEN. The second color GREEN is the same as the second position in FIG. 11 and indicates a hold condition. It should be appreciated that in other various exemplary embodiments, other colors may be used.

While not shown, it is contemplated by the device 310, that other various exemplary embodiments may have include a plurality of sachets disposed within the container, wherein at least one of the sachets contains an anti-microbial and at least another sachet contains a choice of the user to have the capability to release at least one agent into the container to gain the desired effect of the user. Examples of some available for release into the container are but not to, an insecticide, anti-microbial agent, carbon dioxide, ethylene gas, nitrogen gas or a combination.

It should further be appreciated that any of the valves incorporated with the containers of the present invention may also be utilized in connection with and/or to facilitate vacuum cooling as is often conventionally done with items, such as but not limited to produce. The containers are place in a vacuum so that the atmospheric pressure around the container, and hence the items within the container, is reduced. This then reduces the water vapor pressure around the item and when the atmospheric temperature is lowered below the temperature inside the item, such as the produce, water will evaporate from the item. This in turn lowers the surface temperature of the product.

Figure 13:
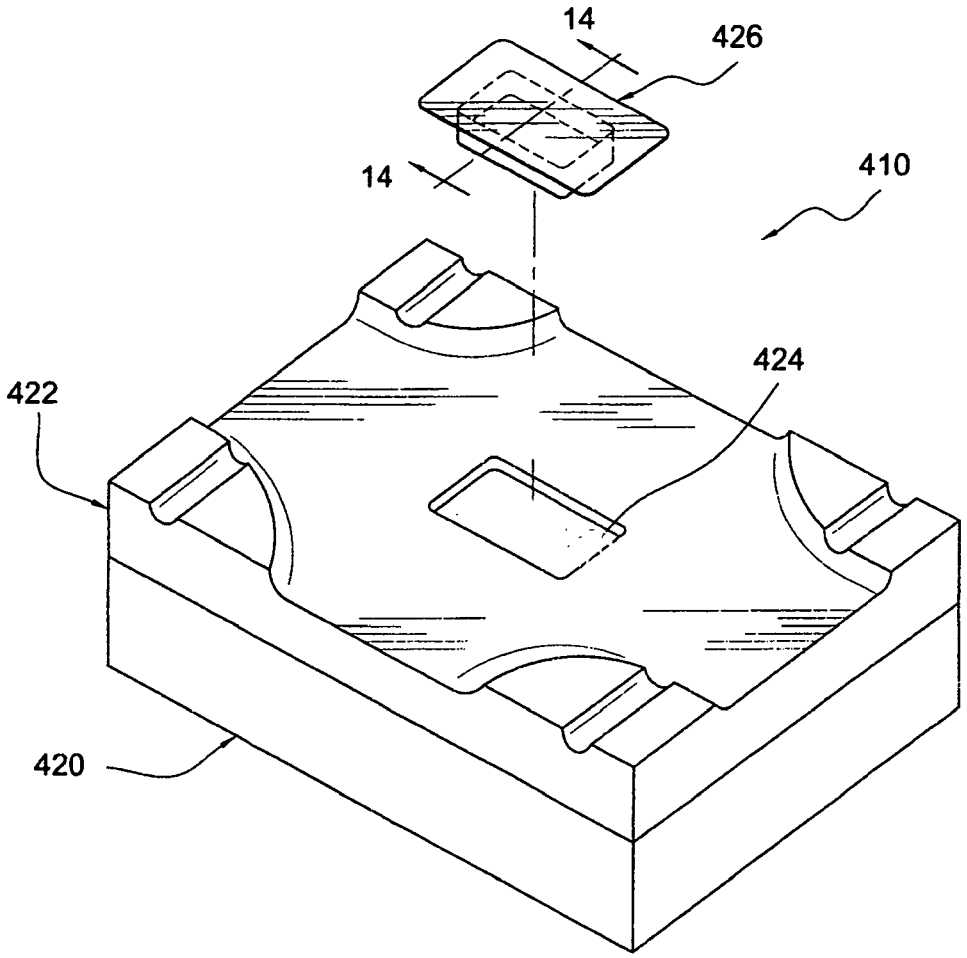
FIG. 13 is a perspective view of another alternative embodiment of the packaging system of FIG. 1.

Now referring to FIG. 13, a device 410, is another exemplary embodiment of the present invention. Device 410 includes a container 420 having a lid 422, an insertable pouch 426 and an at least one agent releasable sachet 440 disposed within the insertable pouch 426.

The container 420 in FIG. 13 is similar to the container 20 in FIG. 1. The lid 422 is likewise similar to the lid 22 in FIG. 1. The lid 422 is different from the lid 22 in that the lid 422 includes an orifice 424 instead of a recessed area.

Figure 14A:
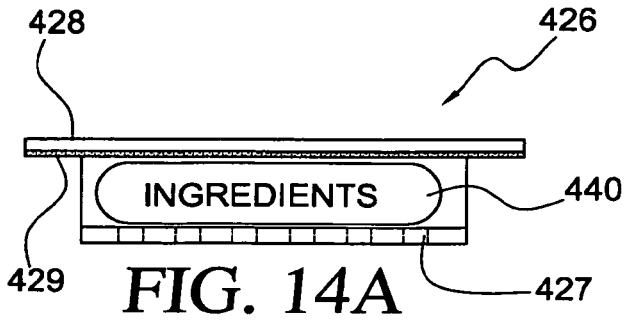
FIG. 14A is cross-sectional view of a pouch of the device shown in FIG. 13 taken along line 14-14.
Figure 14B:
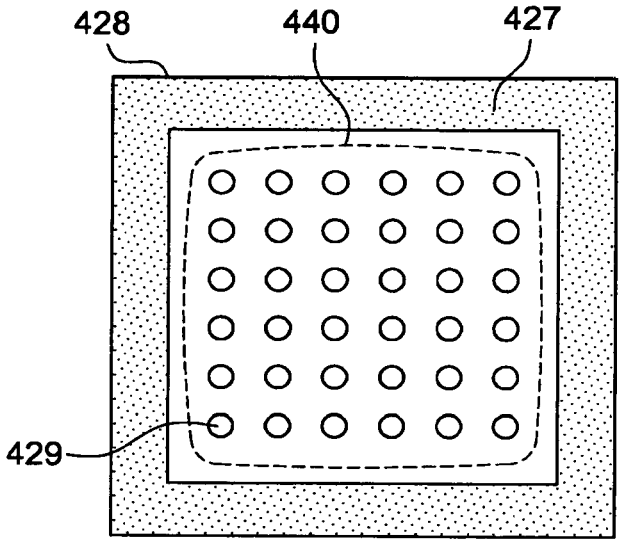
FIG. 14B is a bottom view of the pouch shown in FIG. 14A.

The at least one agent releasable sachet 440 includes the features of the at least one agent releasable sack 40 described above for device 10. The insertable pouch 426 includes a permeable membrane 227 and an adhesive portion 229, as shown in FIGS. 14A and 14B. The insertable pouch 426 is operably configured to be inserted into the orifice 424 on the lid 422 of the container 420. The adhesive portion 429 secures the insertable pouch 426 to the lid 422.

Figure 15:
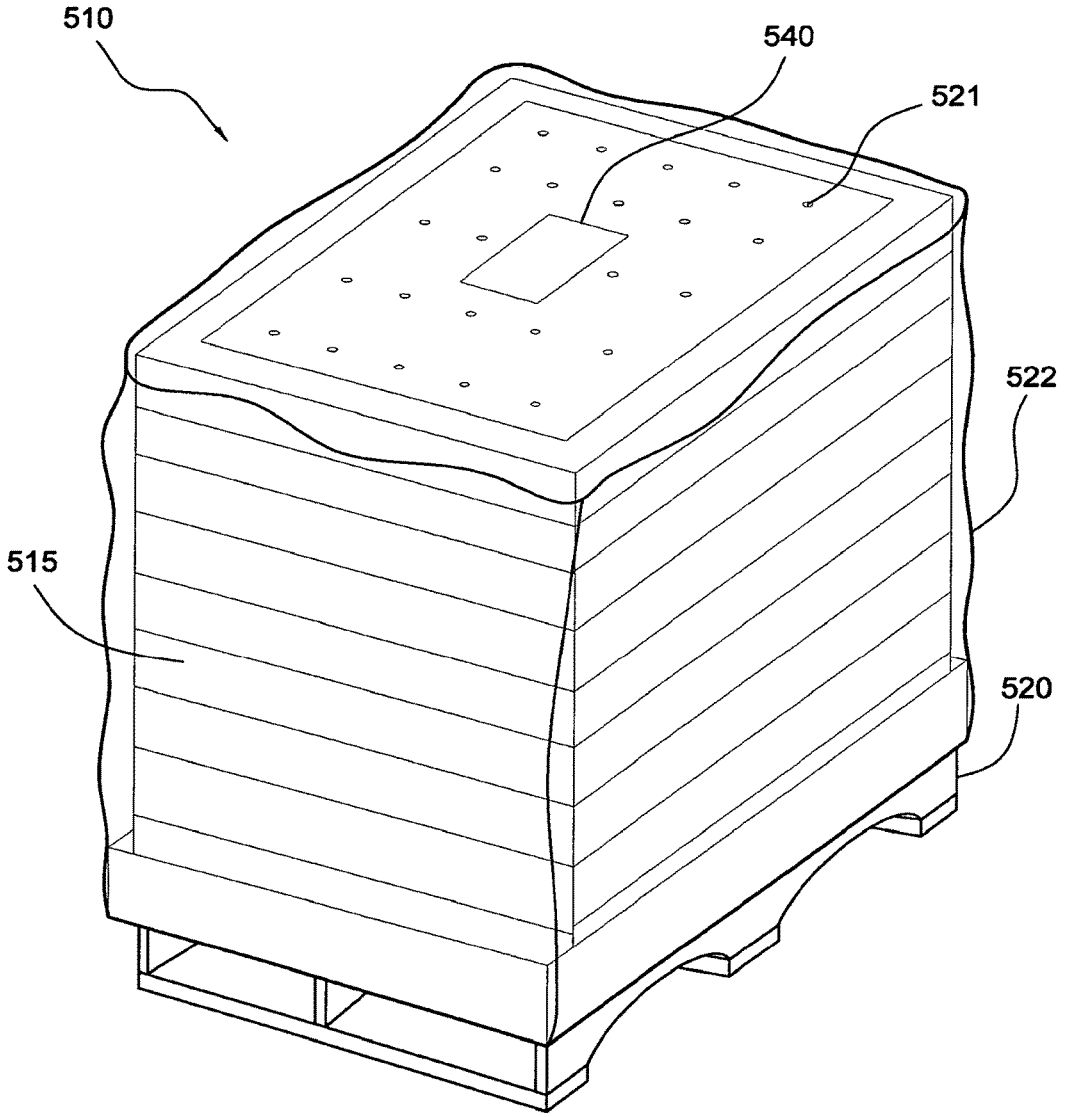
FIG. 15 is a perspective view of another alternative embodiment of the packaging system of FIG. 1.

Now referring to FIG. 15, device 510 is shown. The device 510 includes a pallet 520, cover or bag 522 and an at least one gas releasable sachet 540. The cover 522 is placed over a pallet 520 having perishable goods 515 piled on the pallet 520. The device 510 further includes a protective sheet 521 disposed on top of the perishable goods 515 and within the cover 522. The at least one gas releasable sachet 540 is disposed on the protective sheet 521. The protective sheet 521 keeps the at least one gas releasable sachet 540 from coming in contact with the perishable goods 515. The bag 522 is sealed to the pallet 520 by means common in the art.

The device 510 is similar to the device 10 and includes the features discussed above. As with the device shown in FIG. 1, the device 510 shown in FIG. 15, the at least one agent releasable sachet 540 is a dry chemical sachet, commonly known in the art of dry chemical sachets, a FDA GRAS or foreign lands approved insecticide such as, but not limited to, sulfur dioxide. However, it should be appreciated that in other various exemplary embodiments, the sachet 540 may contain an anti-microbial such as but not limited to chlorine dioxide. Still further, the sachet 440 may contain releasable gases such as but not limited to ethylene or nitrogen.

Further, FIG. 15 shows only a single at least one agent releasable sachet 540 within the cover 522. It should be appreciated that in other various exemplary embodiments, multiple chambers may be disposed within the non-rigid bag.

It should be appreciated that the present invention may also be used to treat, namely kill or inhibit, various molds, such as green mold (*penicillium digitatum*), blue mold (*penicillium italicum*), phomopsis stem-end rot (*phomopsis citri*), stem end rot (*lasiodiplodia theobromae*) and brown rot (*phytophthora citrophthora*).

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

I claim:

1. A packaging system, comprising:

a container with an open top portion and a removable lid covering the open top portion of the container, wherein the lid includes a recess disposed on an exterior side of the lid, with air passages from a bottom of the recess into the container, and elevated portions on top corners of the lid;

a dry agent releasable sack having an agent therein and being disposed within the recess, the sack being operably configured to release the agent within the container through the air passages of the recess; and an adhesive patch covering an exterior of the recess to retain the at least one agent releasable sack within the recess.

2. The packaging system, as recited in claim 1, wherein the releasing of the agent is based upon a humidity of within the container.

3. The packaging system, as recited in claim 1, wherein the agent is at least one of chlorine dioxide, ethylene, nitrogen and an insecticide.

4. The packaging system, as recited in claim 1, further including a second agent releasable sack having a second agent disposed therein.

5. The packaging system, as recited in claim 1, further comprising a valve on a side of the container, wherein the valve is operably configured to release a gas from within the enclosed container.

6. The packaging system, as recited in claim 4, wherein the agents within the agent releasable sacks is at least one of chlorine dioxide and sulfur dioxide.

7. The packaging system, as recited in claim 4, wherein both the first and the second agent releasable sacks are disposed within the recess on the lid.

8. The packaging system, as recited in claim 1, wherein there are a plurality of recesses disposed on the exterior side of the lid, each recess having one or more different agent releasable sacks therein.

9. The packaging system, as recited in claim 1, wherein the adhesive patch is composed of plurality of layers of variable permeability.

10. The packaging system, as recited in claim 9, wherein a layer of the adhesive patch is non-permeable and removable via a tab extending from an edge of the patch.

11. The packaging system, as recited in claim 1, wherein the container is made from a non-rigid material.

12. The packaging system, as recited in claim 1, wherein the container is a modified atmosphere container.

13. The packaging system, as recited in claim 1, wherein the container is formed from at least one of cardboard, corrugate plastic and recyclable plastic.

14. The packaging system, as recited in claim 1, wherein the container is air permeable.

* * * * *